US006497473B2

(12) United States Patent
Kim

(10) Patent No.: US 6,497,473 B2
(45) Date of Patent: Dec. 24, 2002

(54) WIPING APPARATUS FOR AN INK JET PRINTER

(75) Inventor: Dong-Hun Kim, Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/772,852

(22) Filed: Jan. 31, 2001

(65) Prior Publication Data

US 2001/0024216 A1 Sep. 27, 2001

(30) Foreign Application Priority Data

Mar. 25, 2000 (KR) ..... 2000-15295

(51) Int. Cl.[7] ..... B41J 2/165
(52) U.S. Cl. ..... 347/33; 347/32
(58) Field of Search ..... 347/33, 32

(56) References Cited

U.S. PATENT DOCUMENTS 4,500,895 A * 2/1985 Buck et al. ..... 347/87
5,394,178 A * 2/1995 Grange ..... 347/32
5,548,310 A 8/1996 Binnert et al.
5,847,728 A * 12/1998 Lee ..... 347/33

FOREIGN PATENT DOCUMENTS

JP 7-32611 A * 2/1995 ..... B41J/2/175
JP 9-29986 2/1997

* cited by examiner

*Primary Examiner*—John S. Hilten
*Assistant Examiner*—Shih-Wen Hsieh
(74) *Attorney, Agent, or Firm*—Robert E. Bushnell, Esq.

(57) ABSTRACT

The present invention relates to a wiping apparatus for an ink jet printer, which apparatus prevents the area surrounding the wiping apparatus from being contaminated by ink. The wiping apparatus reduces the amount of ink splashed on the surroundings when a wiper is out of the lower part of a cartridge. The apparatus comprises a housing having an upper part which is open, a cartridge which can be moved from one side to another side in an upper part of the housing, a nozzle for ejecting ink and provided on one side of the cartridge, a wiper installed on an upper part of the housing and made of an elastic material for cleaning the nozzle, a holding unit for holding the wiper and rotatable in a direction of the nozzle when the wiper is bent in one direction for cleaning the nozzle, and an operation unit which operates the holding unit and is provided to move together with the cartridge.

17 Claims, 8 Drawing Sheets

WIPING APPARATUS FOR AN INK JET PRINTER

CLAIM OF PRIORITY

This application makes reference to, incorporates the same herein, and claims all benefits accruing under 35 U.S.C. §119 from my application WIPING DEVICE FOR INK JET PRINTER filed with the Korean Industrial Property Office on Mar. 25, 2000 and there duly assigned Ser. No. 15295/2000.

BACKGROUND OF THE INVENTION

1. Technical Field

The present invention relates to an ink jet printer and, more particularly, to an ink jet printer having a wiping apparatus which can prevent ink smeared on a wiper from splashing onto the surroundings when the wiper, wiping out ink remaining on a nozzle of a cartridge, is restored to its original state.

2. Related Art

In general, an ink jet printer is an apparatus which prints text or image data on a paper by ejecting ink from a cartridge in a vapor state through a nozzle.

Such an ink jet printer generally has a printing unit and a maintenance station, and the maintenance station has a wiping apparatus wherein a wiper is installed for cleaning ink smeared on the nozzle from ink ejected through the nozzle of the cartridge. The wiper is usually made of an elastic material, and the nozzle is cleaned by the wiper as the cartridge proceeds to the right and left of the wiper.

In an ink jet printer set forth in U.S. Pat. No. 5,548,310, two wipers of different sizes are installed to wipe ink smeared on a nozzle of a cartridge, and an installed wiper portion is capable of going up and down by means of a spring. According to U.S. Pat. No. 5,548,310, the extent of wiper bending can be reduced to a small extent because the installed wiper portion can go up and down. However, because the restoration of the wiper by self elasticity after cleaning the nozzle cannot be controlled, the splashing of the remaining ink smeared on the wiper onto the surroundings cannot be effectively controlled.

In Japanese Patent Publication No. 9029986(Feb. 4, 1997), in order to partially overcome the latter problems, there is disclosed an apparatus which prevents ink on the wiper from splashing onto the paper by preventing nozzle cleaning when the wiper is restored in the direction of the paper when the wiper is separated from the nozzle during the nozzle cleaning by the wiper. According to the Japanese Patent Publication No. 9029986, the splashing of the remaining ink in the nozzle onto the paper can be prevented. However, the splashing of the ink in the contrary direction cannot be prevented.

Thus, according to the conventional technology, cleaning of the nozzle provided in the cartridge of the ink jet printer, or prevention of the splashing of ink smeared on the wiper onto the paper, can be provided. However, the problem of ink smeared on the wiper splashing onto the surroundings of the wiping apparatus, thus contaminating the wiping apparatus itself, cannot be prevented.

Therefore, if the ink smeared on the wiping apparatus by the wiper accumulates continuously and becomes hardened, it contaminates the bottom of the cartridge or the bottom surface of a carriage, and if the contaminated cartridge and carriage move to the paper for printing, the paper itself is contaminated.

SUMMARY OF THE INVENTION

The present invention has been completed in view of the above-described problems involved in the prior art, and it is an object of the present invention to provide an ink jet printer which can prevent ink smeared on a wiper from splashing onto a wiping apparatus of the ink jet printer after cleaning a nozzle.

It is another object of the present invention to provide an ink jet printer having a wiper holding unit to prevent ink from a wiper from splashing onto the surroundings of a wiping apparatus by minimizing a restoration distance of the wiper itself when the bent wiper is restored during cleaning a nozzle and after completing the cleaning of the nozzle.

It is still another object of the present invention to provide an ink jet printer having an operation unit for operating a wiper holding unit which holds and supports a bent-wiper during cleaning of a nozzle.

According to one aspect of the present invention, a wiping apparatus of an ink jet printer comprises: a housing having an upper part which is open; a carriage which can be moved from one side to another side in an upper side of the housing; a cartridge which is transported by the carriage, and wherein ink is stored; a nozzle which is installed facing the housing and on an outer side of a bottom surface of the cartridge, and which ejects ink from the cartridge during printing; and a wiper installed on the top of the housing and which is made of an elastic material for cleaning the nozzle. The wiping apparatus further comprises: a moving member which moves upward when moving to one side from a top of the housing under the guidance of a slant guide hole formed on a side wall of the housing, and which moves downward when the cartridge moves to another side of the housing; a locking member which moves together with the moving member, being joined axially to one side of the moving member, and which has an attaching/detaching projection attached/detached to/from an attaching/detaching groove formed on the bottom of the housing in order to maintain the elevated position of the moving member when the moving member has been elevated; a holding unit for holding a wiper by rotating in the direction of the nozzle and bending if the wiper is bent to one direction during cleaning of the nozzle; and an operation unit which operates the holding unit, the latter being provided so as to move together with the cartridge.

A holding unit according to the present invention comprises: a rotation rod whose lower part is joined axially to a locking member so as to be rotated by the operation unit, and a holding rod which supports one side of a wiper, and which extends to the wiper from the rotation rod. In addition, the holding unit comprises a restoring unit to restore the holding unit when an external force applied from the operation unit is removed. The restoring unit is constructed with a tension spring having one end which is engaged to the locking unit and another end which is connected to the rotating rod. Moreover, the operation unit includes an operation rod extending toward the rotating rod from a cartridge. One end of the rotating rod comprises a projecting portion extending toward the housing, and the holding unit is adjacent to one side of a wiper, and extends toward the wiper from a projection. Thus, the holding unit prevents the splashing of ink from the wiper by controlling the restoration operation of the wiper after the wiper has cleaned the nozzle.

A holding unit according to the present invention comprises: a rotating rod whose lower part is joined axially to a locking member so as to be rotated by the operation unit, and a holding unit which supports one side of a wiper, and which extends to the wiper from the rotating rod. In addition, the holding unit comprises a restoring unit to restore the holding unit when an external force applied from the operation unit is removed. The restoring unit is constructed with a tension spring having one end which is engaged to the locking unit and another end which is connected to the rotating rod. Moreover, the operation unit includes an operation rod extending toward the rotating rod from a cartridge. One end of the rotating rod comprises a projecting portion extending toward the housing, and the holding unit is adjacent to one side of a wiper, and extends toward the wiper from a projection. Thus, the holding unit prevents the splashing of ink from the wiper by controlling the restoration operation of the wiper after the wiper has cleaned the nozzle.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, and wherein.

DETAILED DESCRIPTION OF THE PREFERRED EMBODIMENTS

A wiping apparatus of an ink jet printer according to a preferred embodiment of the present invention will hereinafter be described in detail with reference to the accompanying drawings.

Figure 1:
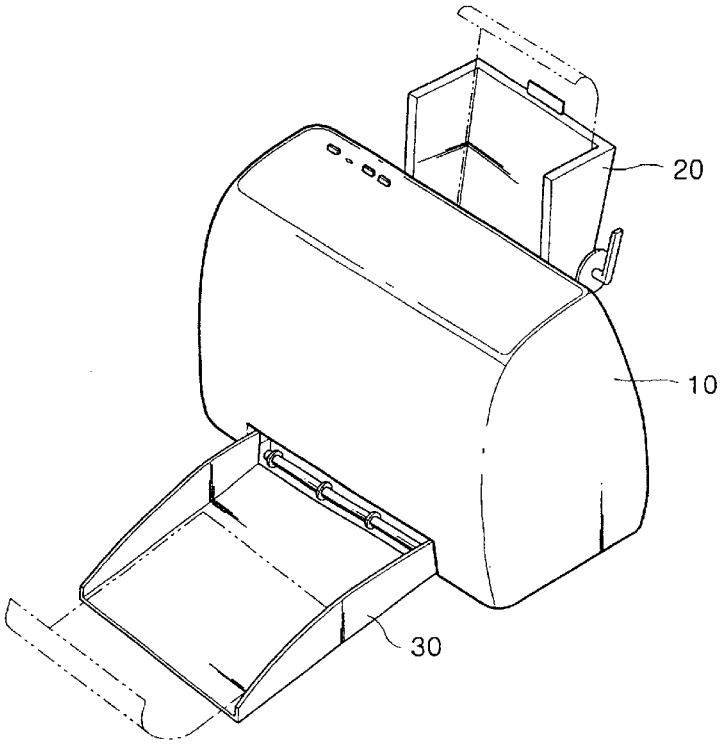
FIG. 1 is a perspective diagram showing an ink jet printer having a wiping apparatus according to the present invention.
Figure 2:
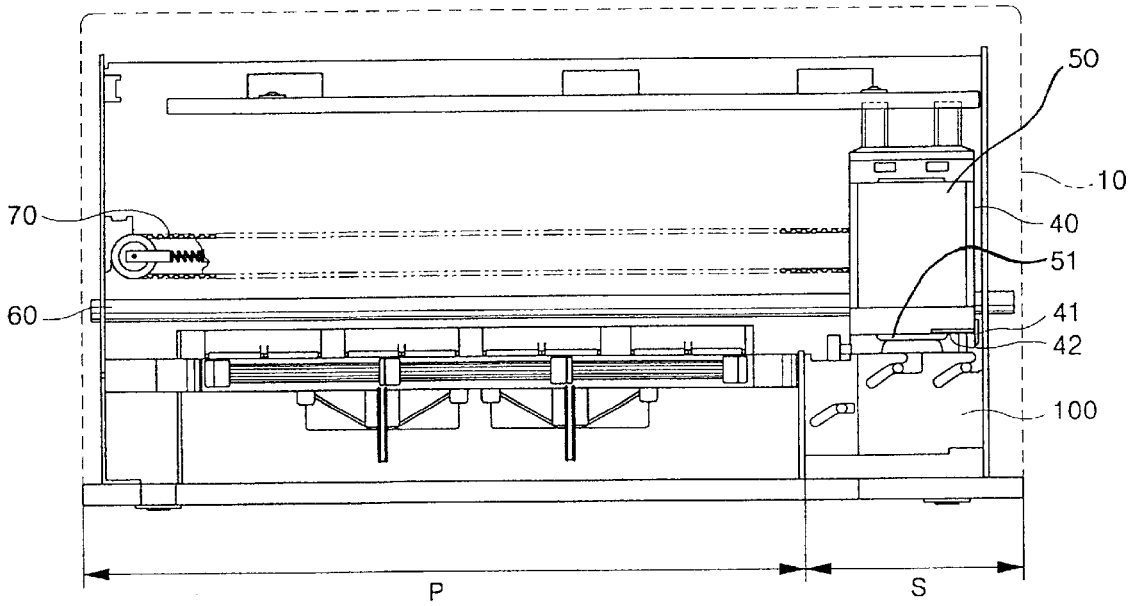
FIG. 2 is an elevation diagram showing an ink jet printer having a wiping apparatus according to the present invention.

As shown in FIG. 1 and FIG. 2, an ink jet printer according to the present invention comprises: a body 10; a paper feeding part 20 provided on the rear part of the body 10; a paper supporting board 30 which is provided in front of the body 10, and wherein printed and exhausted papers are loaded; and a guide axis 60 and a belt 70 which enable the transportation to the left and to the right about the central portion of the body 10.

The ink jet printer also comprises: a carriage 40 which is installed by being inserted between the guide axis 60 and the belt 70; a cartridge 50 where ink is stored; and a nozzle 51 provided in the cartridge 50 and through which ink is ejected.

The body 10 is segmented into a printing area P where printing of the paper is performed during the movement of the carriage 40, and a service area S which cleans ink smeared on the nozzle 51. A maintenance unit is provided in the service area S, and the maintenance unit has a wiping apparatus 100 for cleaning the nozzle 51 of the cartridge 50, and a capping unit 170 which seals up the nozzle 51 when the printing is not performed, and which is installed together with the wiping apparatus 100.

Figure 3:
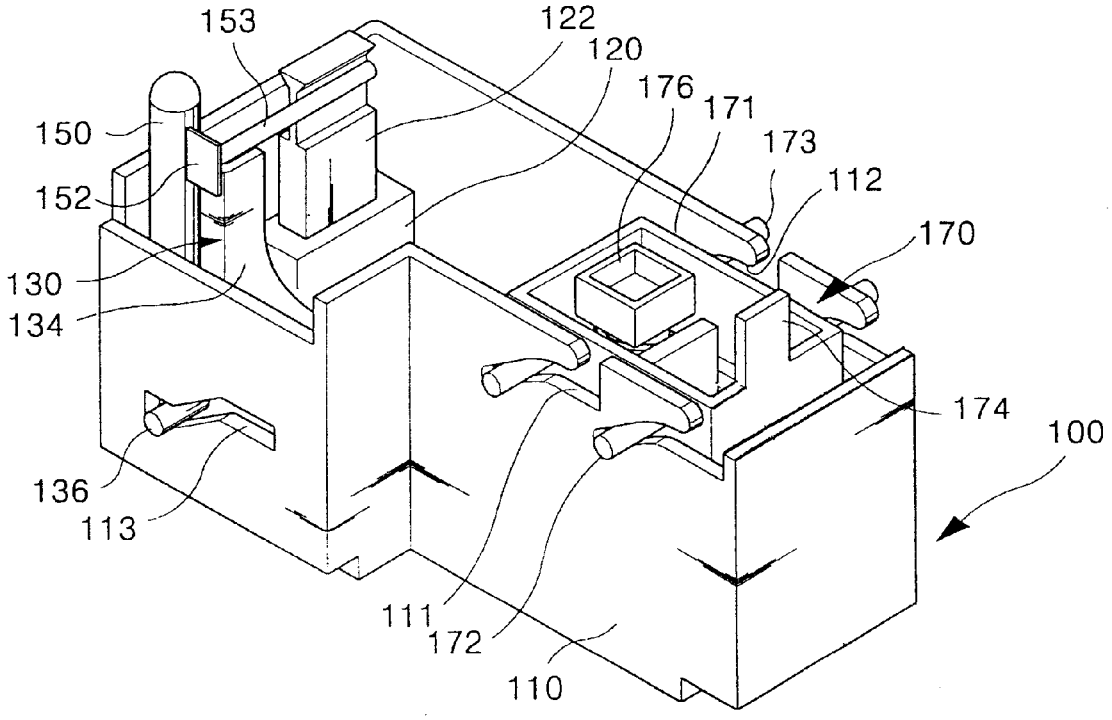
FIG. 3 is a partially enlarged fragmentary perspective diagram showing a wiping apparatus of an ink jet printer according to the present invention.
Figure 4:
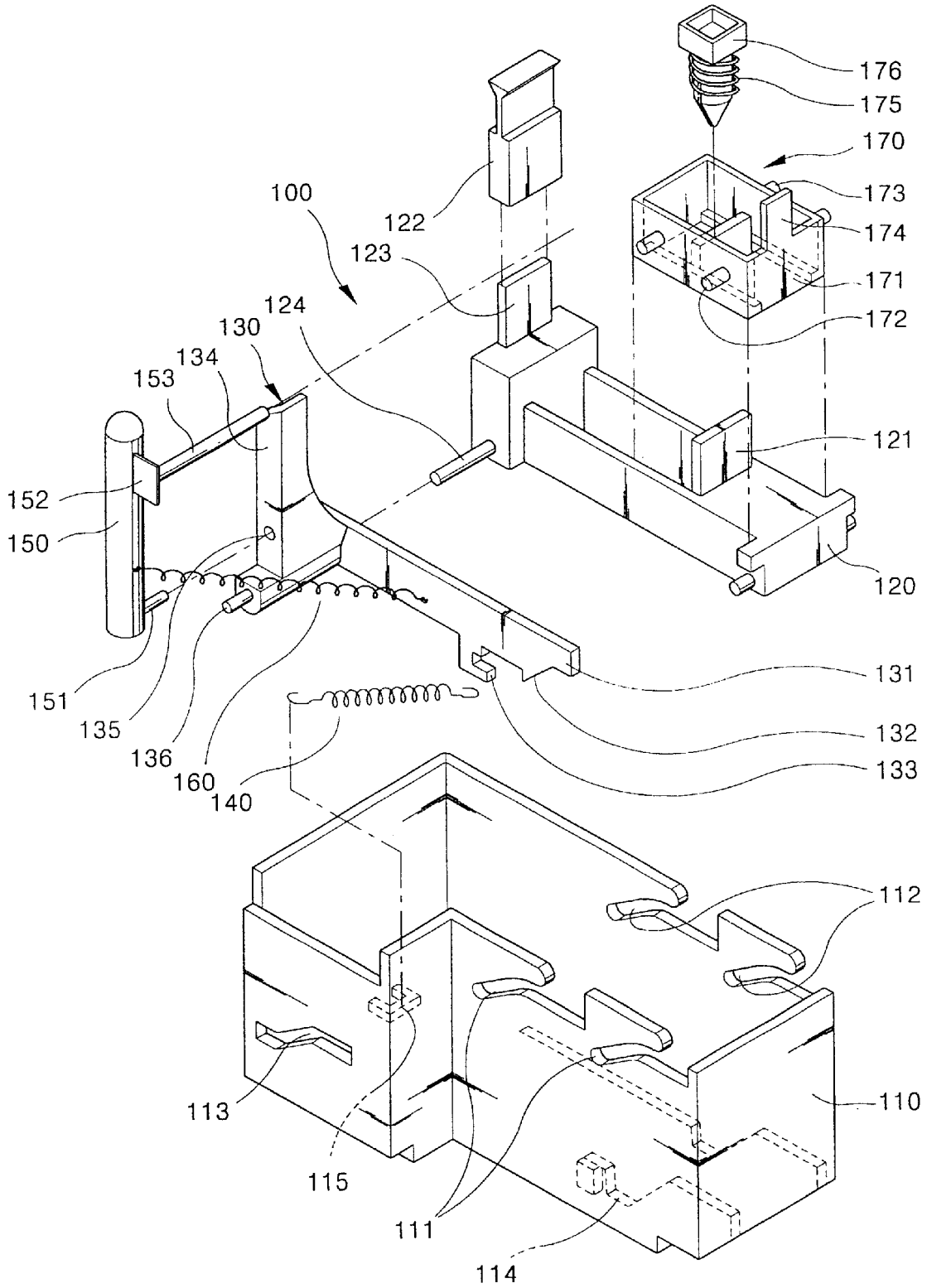
FIG. 4 is an exploded perspective diagram showing a wiping apparatus of an ink jet printer according to the present invention.

The wiping apparatus 100, as shown in FIG. 3 and FIG. 4, comprises a housing 110, a moving member 120, a locking member 130, and a holding unit as a whole.

First, the housing 110 is structured in a right-angled hexagonal shape, has a top which is open, and forms a space part where a part adjacent to the printing area P is projected and prolonged toward the front in order for a part of the locking member 130 and the holding unit to be located.

A number of cap holes 111 and 112, which are prolonged and slanting, upward and to the outside, from the printing area P, and where the capping unit 170 is combined due to the entrance being upwardly open, are formed on both sides of the housing 110. The cap holes 111 and 112 are provided as two first cap holes 111 formed on the left side wall of the housing 110 and two second cap holes 112 formed on the right side wall of the housing 110.

A guide hole 113, prolonged and slanting upward and to the right, is formed in the space part of the left lower part of the first cap holes 111, and an attaching/detaching groove 114 is formed on the right part of the bottom of the housing 110, while a connecting sill 115 is formed on the left part of the bottom.

The moving member 120 is formed in the shape of an "L", and comprises a supporting sill 121 projecting upward in the top of the center, and a wiper 122 is installed on the left end. For the installation of the wiper 122, a combining sill 123 projecting upward is formed on the left end of the moving member 120, and the wiper 122 is formed with a square plate body in order to be combined by being inserted, and is formed of an elastic material, such as a rubber.

Continuously, the locking member 130 is combined with the side part of the moving member 120, is in the shape of an "L", and comprises a connecting part 131 prolonged to the bottom of the housing 110 and a supporting part 134 prolonged upward along the side wall of the housing 110.

A right-angled triangular attaching/detaching projection 132 attached/detached to an attaching/detaching groove 114 of the housing 110 is formed on the bottom of the right side of the connecting part 131, a connecting projection 133 is formed in the side of the attaching/detaching projection 132, and one end and another end of a locking spring 140 are combined in the connecting projection 133 and the connecting sill 115 of the housing 110, respectively, so that restoration as to the rotation operation of the locking member 130 is possible.

The supporting part 134 is prolonged so as to be parallel with the installation state of the wiper 122, and an axis hole 135 is formed on the center part of a surface facing the housing 110. A combining projection 124 projected from the moving member 120 is inserted on the boundary with the connecting part 131, and a guide projection 136, which is made to be inserted into the guide groove 113 of the housing 110 which is projected or extends toward the housing 110, is formed on the lower part of the supporting part 134.

On the other hand, in the axis hole 135, a holding unit is prepared which holds the restoration operation of the wiper 122 when the wiper 122 is bent by a nozzle 51 during cleaning of the nozzle 51, and an operation unit to operate the holding unit is provided in the carriage 40.

First, the holding unit comprises a rotation rod 150 where an axis projection 151 engageable with axis hole 135 of the locking member 130 is formed on a lower part, and a projection 152 projecting or extending toward the housing 110 is provided on the upper part of the rotation rod 150. On the projection 152, a holding rod 153 is formed to support the side of the wiper 122, the rod 153 being prolonged to the side of the wiper 122.

The holding rod 153 crosses one side of the wiper 122 from one side to another side, and it is desirable that the interval with the side of the wiper 122 be minimized.

A restoring unit, in the form of a tension spring 160, is installed between a midpoint of the rotation rod 150 and the side of the locking member 130, thus joining them. The tension spring 160 restores the rotation rod 150 to its original state after an external force is applied to the rotation rod 150 from the operation unit to rotate rod 150, and is removed.

As shown in FIG. 2 and FIG. 4, the operation unit is realized by an operation rod 42 which rotates the rotation rod 150 by pushing it, the rod 150 extending toward the printing area in the outer end of the carriage 40 when the carriage 40 moves to the printing area.

The capping unit 170 is in the shape of a square depressed body inserted into the supporting sill 121 formed on the upper part of the moving member 120, and comprises a cap body 171 having a part of its upper part and its lower part open, a touch lever 174 which enables the cap body 171 to slide to the right and left when pushed by an operation plate 41 formed in the carriage 40 (shown in FIG. 2), the touch lever 174 projecting from the upper part of the cap body 171, and a cap 176 supported elastically by a cap spring 175 on an opposite part of the touch lever 174.

Also, two first cap projections 172 to be inserted into the first cap holes 111 of the housing 110 are formed on one side of the outer surface of the cap body 171, and two second cap projections 173 to be inserted into the second cap holes 112 of the housing 110 are formed on another side of the outer surface of the cap body 171.

Figure 5:
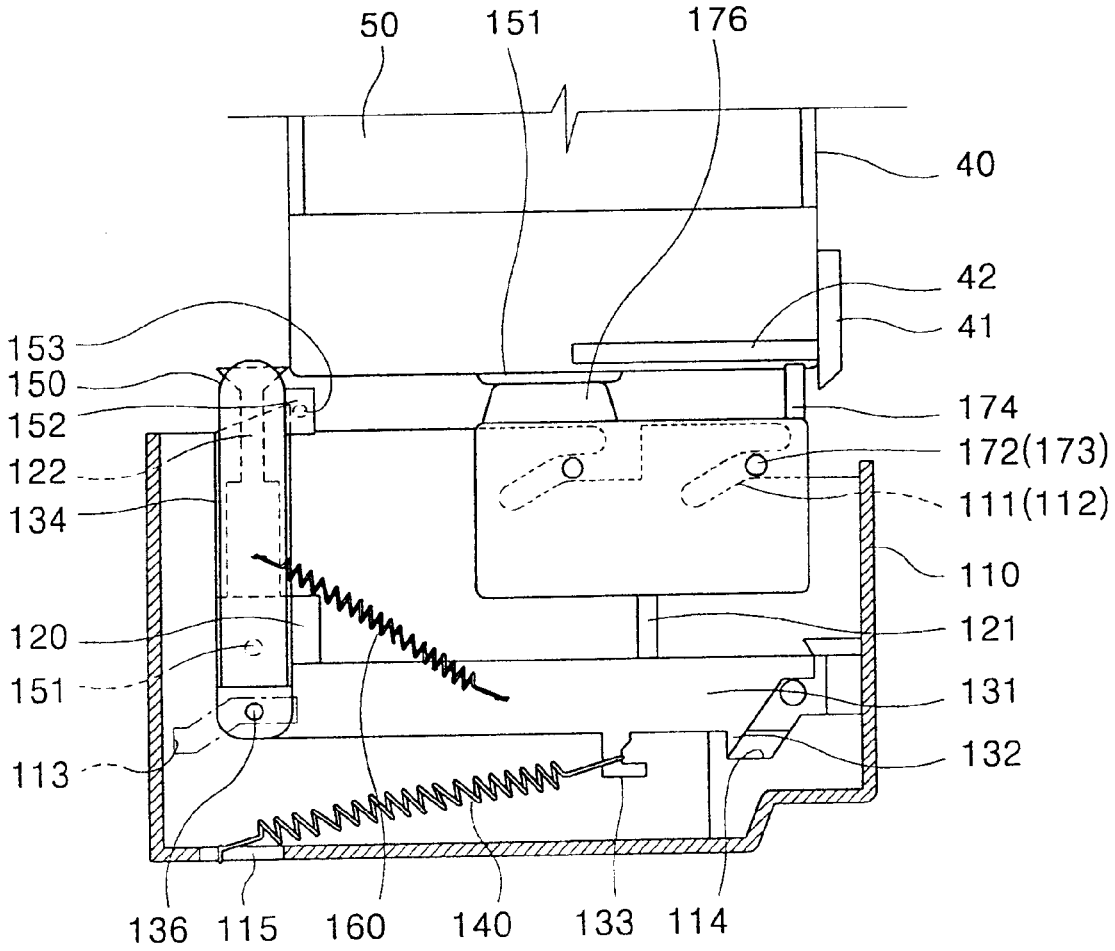
FIG. 5 is a drawing showing the state wherein a cartridge is inserted into a wiping apparatus, and specifically a side elevation showing an incised housing in the wiping apparatus according to the present invention.

The operation of an ink jet printer constructed according to the present invention will hereinafter be described with reference to FIGS. 3, 4 and 5.

According to the present invention, printing on paper by the ink jet printer is performed as carriage 40 moves to be right and left over the printing area P. During printing, or if printing is ended, the carriage 40 moves to the service area S.

At this time, the initial entry state of the carriage moved to the service area is that the attaching/detaching projection 131 of the locking member 130 is not inserted into the attaching/detaching groove 114 of the housing 110, and the cap 176 is not adhered closely to the nozzle 51. That is, the moving member 120, the locking member 130 and the capping unit 170 are located in a downward position relative to the lower part of the housing 110.

If the carriage 40 enters the service area S continuously, the operation plate 41 of the carriage 40 pushes the touch lever 174 of the capping unit 170 to the outside, and thus the cap body 171 goes upward along the first cap holes 111 and the second cap holes 112.

At the same time, the supporting sill 121 of the moving member 120 is pulled by the cap body 171, and thus the moving member 120 is moved to the right, and at the same time the guide projection 136 of the locking member 130 moves upward and to the right along the guide hole 113. That is, all components of the wiping apparatus 100 move upward and to the right in the housing 110 in response to action of the operation plate 41 of the carriage 40.

In this state, the moving operation is completed in that the attaching/detaching projection 132 of the locking member 130 is inserted into the attaching/detaching groove 114 of the housing 110, and this is the locking position of the wiping apparatus 100.

In the locking position, the wiper 122 is located adjacent to the carriage 40, the locking spring 140 pulls the supporting part 134 of the locking member 130 as if it is lengthened, and the nozzle 51 is sealed by the cap 176.

The sealing of the nozzle 51 by the cap 176 prevents ink which is smeared on the nozzle 51 from being dried due to the high sealing state caused by the cap spring 175 urging the cap 176 upward with elasticity.

Figure 6:
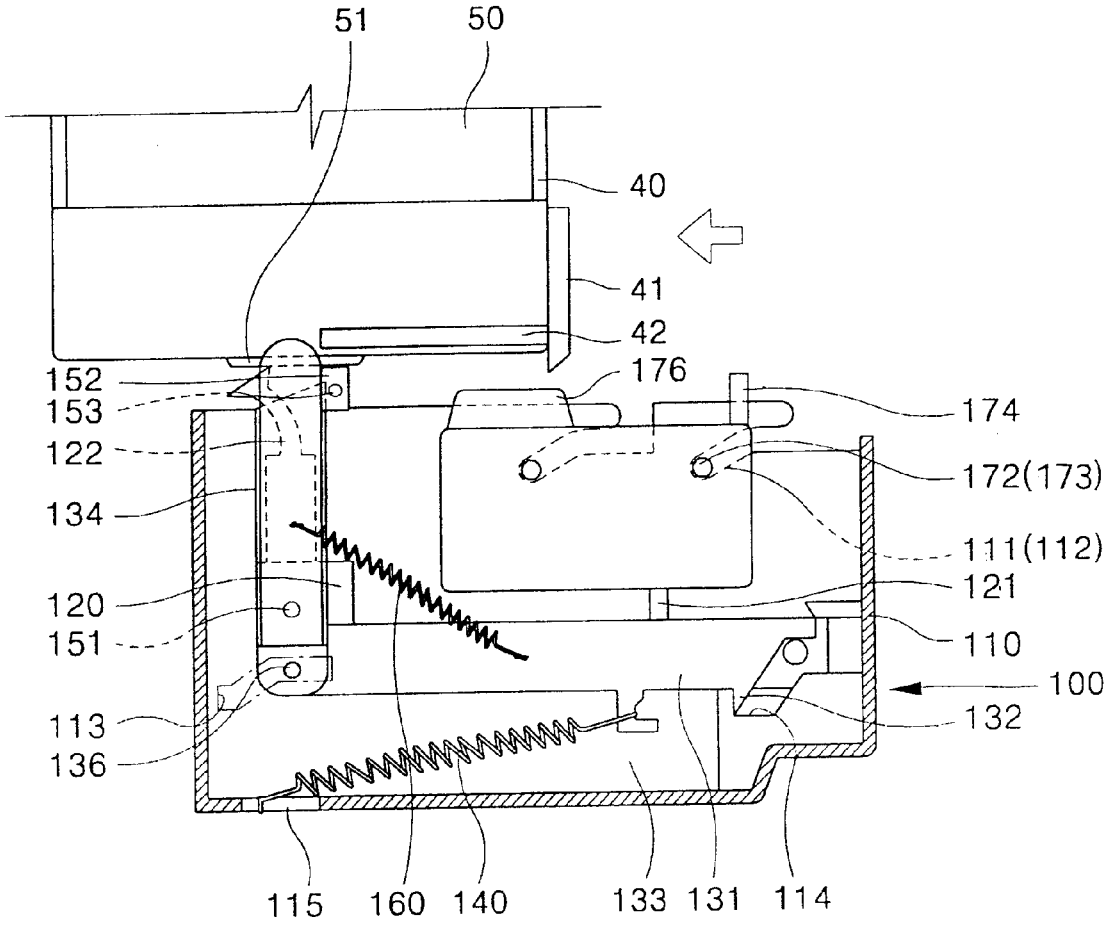
FIG. 6 is a perspective diagram showing an initial cleaning state as to a nozzle of a cartridge, and specifically a side elevation diagram showing an incised housing in a wiping apparatus according to the present invention.

In the state, if the carriage 40 moves to the left to perform the printing operation, as shown in FIG. 6, the operation plate 41 of the carriage 40 pushes the touch lever 174 of the capping unit 170, and the capping unit 170 is pushed by the operation plate 41 of the carriage 40. As a result, the first cap projections 172 and the second cap projections 173 of the cap body 171 move downward along the first cap holes 111 and the second cap holes 112, respectively, of the housing 110, and thus the capping unit 170 maintains an initial state.

In this stage of the operation, the nozzle 51 is separated from the cap 176, and the sealing state is released. By the continuous proceeding of the carriage 40, the wiper 122 is bent to the left as it contacts the nozzle 51.

Figure 7:
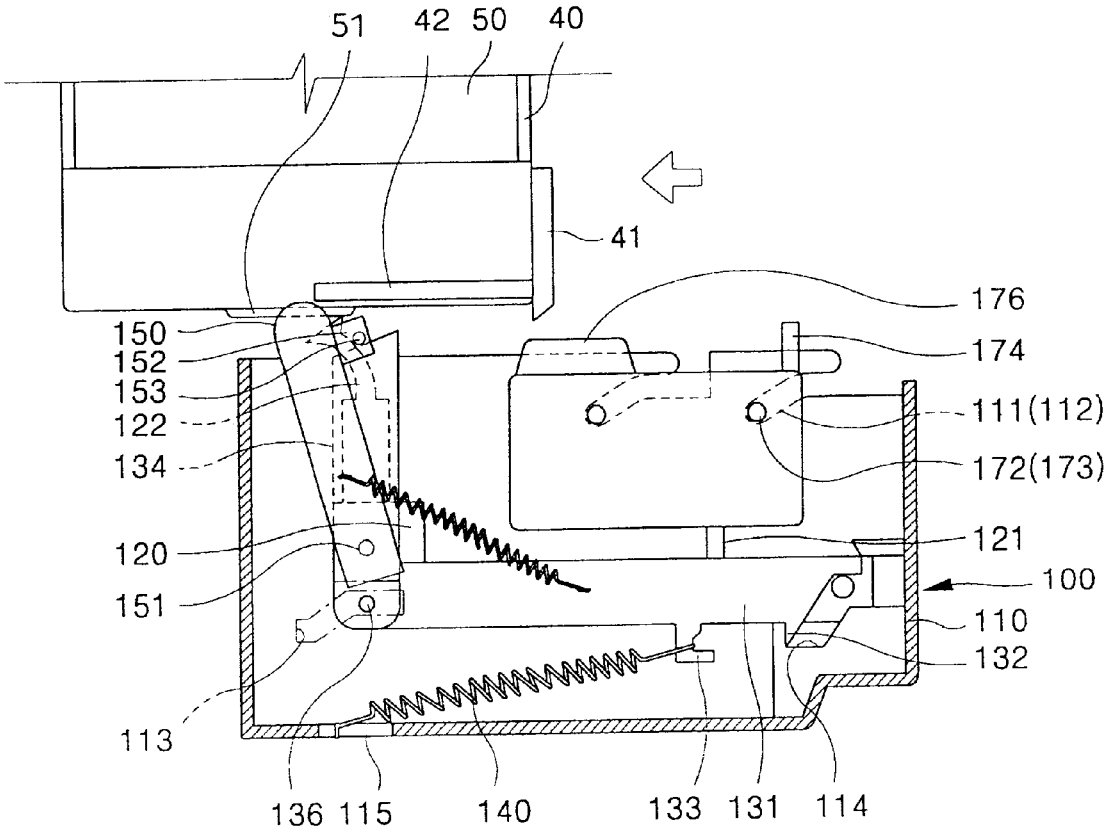
FIG. 7 is a drawing showing the state of cleaning progress as to a nozzle, and is a side elevation diagram showing an incised housing in the wiping apparatus according to the present invention.

In the operational state of FIG. 6, the carriage 40 continues to the left, and is put into the stage of FIG. 7. At this time, as the nozzle 51 passes the bent wiper 122, any ink remnants smeared on the nozzle 51 are wiped by the wiper 122, and at the same time the operation rod 42 of the carriage 40 applies an external force to the upper part of the rotation rod 150.

As a result, the rotation rod 150 is rotated in a direction along which the wiper is bent while, at the same time, the holding rod 153 is also rotated toward the bent part of the wiper 122, and thus maintains a distance with respect to the side of the wiper 122.

Figure 8:
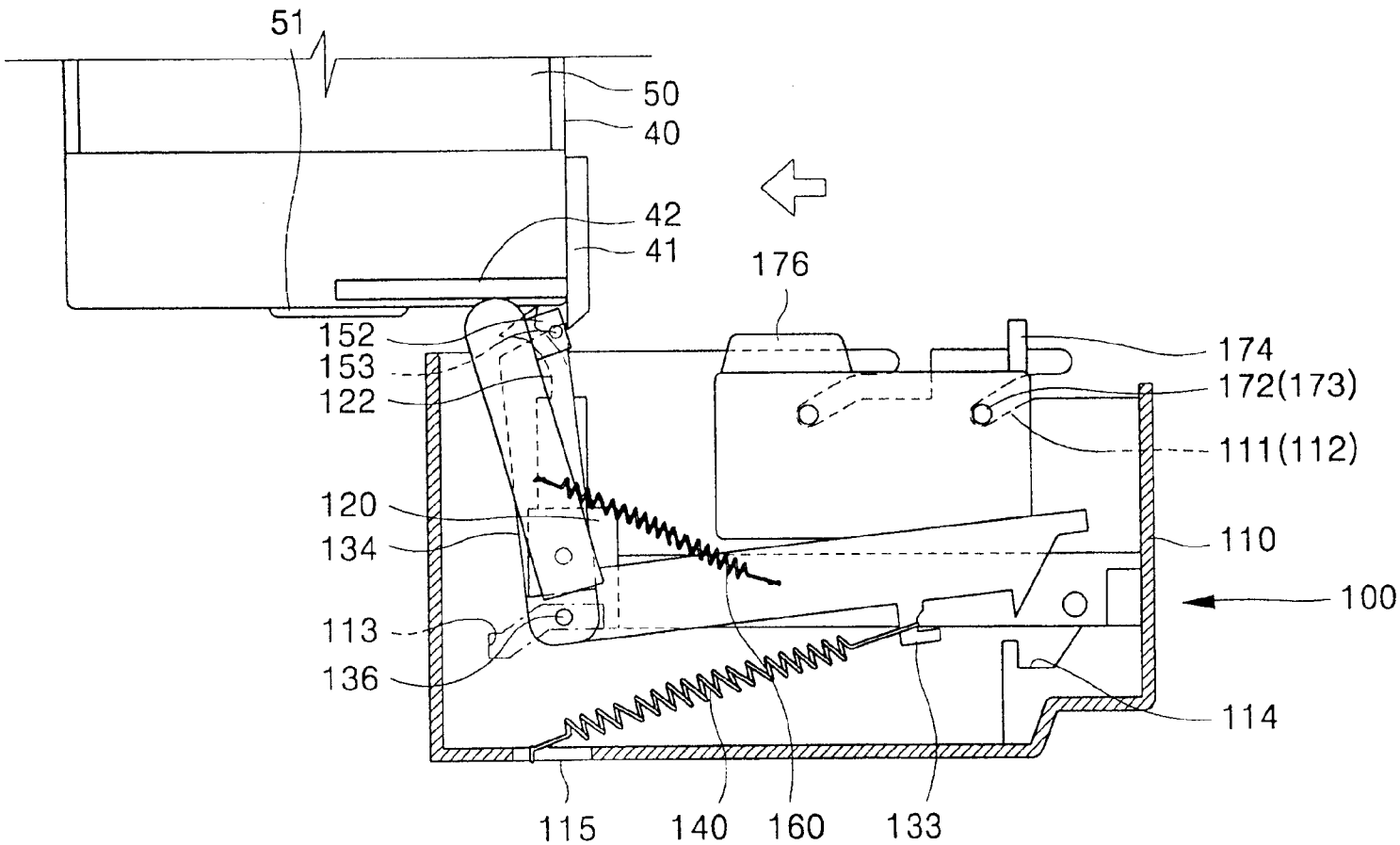
FIG. 8 shows the unlocking state of a locking member after completing the cleaning as to a nozzle, and is a side elevation diagram showing an incised housing in the wiping apparatus according to the present invention.

If the carriage 40 continues to the left, as shown in FIG. 8, when the carriage 40 passes by the operation rod 42, the operation plate 41 of the carriage 40 contacts the supporting part 134 of the locking member 130. Moreover, the operation plate 41 pushes the upper part of the supporting part 134 of the locking member 130.

Therefore, the supporting part 134 of the locking member 130 is rotated to the left, and at the same time the connecting part 131 is rotated upward. Thus the attaching/detaching projection 133 of the connecting sill 131 is separated from the attaching/detaching groove 114 of the housing 133.

Figure 9:
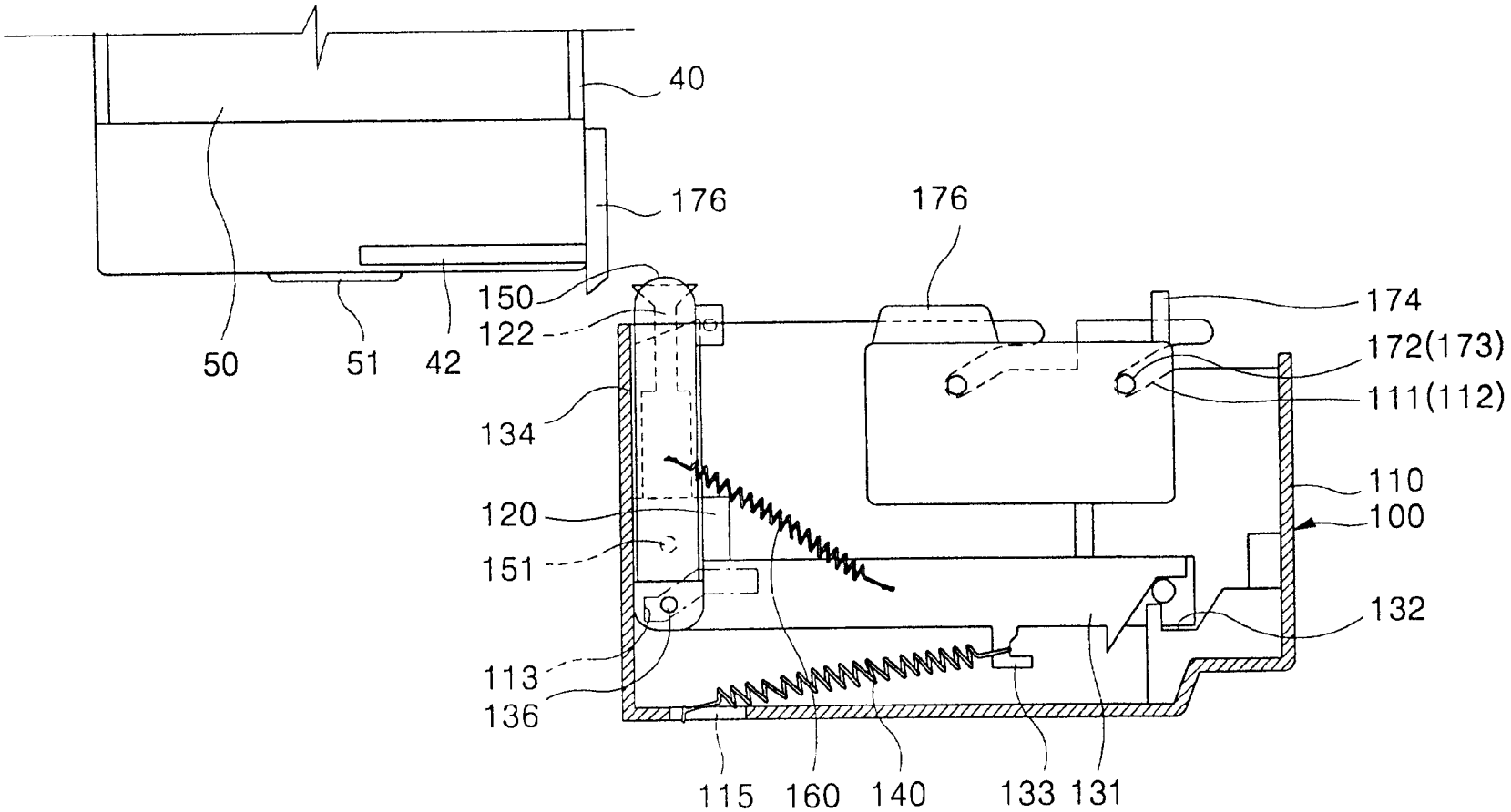
FIG. 9 shows the state in which a cartridge ends the operation of a wiping apparatus, and is a side elevation diagram showing an incised housing in the wiping apparatus according to the present invention.

If the carriage 40 moves out of the service area S, the carriage is in the state shown in FIG. 9, and the operational state at this time is such that, in the locking member 130, the guide projection 136 moves downward along the guide hole 113 due to the restoring force of the locking spring 140, and at the same time the moving member 120 engaged with the locking member 130 also moves downward.

In addition, by removing the external force applied to the rotation rod 150 and the supporting part 134 of the locking member 130 by the operation rod 42 and the operation plate 41, the locking member 130 is restored to its initial state by the locking spring 140, and also the rotation rod 150 of the holding unit is restored by the tension spring 160.

In particular, during the restoration operation, when the nozzle 51 is out of the wiper 122 after cleaning of the nozzle 51 by the wiper 122 is completed, a restoring force to restore the wiper to its initial state by virtue of its elasticity is imposed on the wiper 122. At that point, because the holding rod 153 is very close to the side of the restoration direction, the restoration operation of the wiper is minimized.

When the rotation rod 150 itself is restored, because the wiper 122 is restored to its initial position while being supported by the holding rod 153, the wiper is not bounced by being restored instantaneously, and can be restored stably.

Thus, in the wiping apparatus of the ink jet printer according to the present invention, the restoration distance for the wiper to be restored instantaneously is minimized due to its own elasticity, by providing the holding unit on one side of the locking member, and by providing the holding rod so as to maintain its distance from the wiper in the holding unit, thus reducing the splashing of ink onto the area surrounding the wiper, and preventing the surroundings of the wiping apparatus from being contaminated by ink.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A wiping apparatus for an ink jet printer, comprising:

a housing having a top which is open;

a carriage which can be moved from one side to another side on an upper side of the housing;

a cartridge which is transported by the carriage and which stores ink;

a nozzle which ejects ink toward the housing, said nozzle being installed on a side of the cartridge facing the housing;

a wiper made of an elastic material for cleaning the nozzle, said wiper being installed in an upper part of the housing;

holding means for holding the wiper by being rotated in a direction of the nozzle when the wiper is bent to one side during cleaning of the nozzle; and operation means for operating the holding means and provided so as to move together with the carriage;

wherein the holding means comprises a rotation rod having a lower part which is axially joined to the housing so as to be rotated by the operation means, and a holding rod extending from the rotation rod toward the wiper for supporting a side of the wiper.

2. The wiping apparatus according to claim 1, wherein the holding means further comprises a restoring spring for restoring the rotation rod to an initial position when an external force applied from the operation means is removed.

3. The wiping apparatus according to claim 1, wherein the operation means comprises an operation rod protruding from the carriage toward the rotation rod.

4. The wiping apparatus according to claim 1, wherein said rotation rod includes a projecting portion provided on one end of the rotation rod and extending toward the housing.

5. A wiping apparatus for an ink jet printer, comprising:

a housing having an upper part which is open;

a carriage which can be moved from one side to another side on an upper side of the housing;

a cartridge which is transported by the carriage and which stores ink;

a nozzle which ejects ink toward the housing, said nozzle being installed on a side of the cartridge facing the housing;

a moving member which moves upward when the carriage moves from the upper side of the housing to one side, and which moves downward when the cartridge moves to another side of the housing;

a wiper made of an elastic material and joined to the moving member for cleaning the nozzle, said wiper moving upward with said moving member to clean the nozzle;

a locking member which moves together with the moving member, said locking member being axially joined to one side of the moving member and having an attaching/detaching projection which is alternatively attached to and detached from an attaching/detaching groove formed on a bottom of the housing in order to maintain an elevated position of the moving member when the moving member moves upward;

holding means installed on one side of the locking member for holding the wiper by rotating in a direction of the nozzle when the wiper is bent in one direction during cleaning of the nozzle; and operation means for operating the holding means by applying an external force to the holding means, said operation means being provided so as to move together with the carriage.

6. The wiping apparatus according to claim 5, wherein the holding means comprises a rotation rod having a lower part which is axially joined to the housing so as to be rotated by the operation means, and a holding rod extending from the rotation rod toward the wiper for supporting a side of the wiper.

7. The wiping apparatus according to claim 6, wherein the holding means comprises a tension spring which restores the rotation rod to an initial position when an external force applied from the operation means to the rotation rod is removed, said tension spring having one end joined to the rotation rod and another end joined to the locking member.

8. The wiping apparatus according to claim 7, wherein the operation means includes an operation rod extending to the holding means.

9. An ink jet printer, comprising:

a housing having an upper part which is open;

a carriage which can be moved from one side to another side on an upper side of the housing;

a cartridge which is transported by the carriage and which stores ink;

a nozzle which ejects ink toward the housing, said nozzle being installed on a side of the cartridge facing the housing;

a moving member which moves upward when the carriage moves from the upper side of the housing to one side, and which moves downward when the cartridge moves to another side of the housing;

a wiper made of an elastic material and joined to the moving member for cleaning the nozzle when the moving member moves upward;

a locking member which moves together with the moving member, said locking member being axially joined to one side of the moving member and having an attaching/detaching projection which is alternatively attached to and detached from an attaching/detaching groove formed on a bottom of the housing in order to maintain an elevated position of the moving member when the moving member moves upward;

a rotation rod which extends toward the upper side of the housing, said rotation rod being axially joined to the locking member;

a holding rod which supports a side of the wiper, said holding rod extending from the rotation rod to the side of the wiper; and an operation rod provided on one side of the carriage for causing the holding rod to support one side of the wiper in a direction along which the wiper is bent when the wiper is bent during cleaning of the nozzle.

10. The inkjet printer according to claim 9, further comprising a tension spring which restores the rotation rod to an initial position when an external force applied from the operation rod to the rotation rod is removed, said tension spring having one end joined to the moving member and another end joined to the rotation rod.

11. The inkjet printer according to claim 9, wherein said rotation rod includes a projecting portion provided on one end of the rotation rod and projected toward the housing, and wherein the holding rod extends toward the wiper from the rotation rod.

12. A wiping apparatus for an ink jet printer, comprising:

a housing having a top which is open;

a carriage which can be moved from one side to another side on an upper side of the housing;

a cartridge which is transported by the carriage and which stores ink;

a nozzle which ejects ink toward the housing, said nozzle being installed on a side of the cartridge facing the housing;

a wiper made of an elastic material for cleaning the nozzle, said wiper being installed in an upper part of the housing;

holding means for holding the wiper by being rotated in a direction of the nozzle when the wiper is bent to one side during cleaning of the nozzle; and operation means for operating the holding means and provided so as to move together with the carriage;

wherein the holding means comprises a rotation rod having a lower part which is axially joined to the housing so as to be rotated by the operation means, and a restoring spring for restoring the rotation rod to an initial position when an external force applied from the operation means is removed.

13. The wiping apparatus according to claim 12, wherein the operation means comprises an operation rod protruding from the carriage toward the rotation rod.

14. The wiping apparatus according to claim 12, wherein said rotation rod includes a projecting portion provided on one end of the rotation rod and extending toward the housing.

15. A wiping apparatus for an ink jet printer, comprising:

a housing having a top which is open;

a carriage which can be moved from one side to another side on an upper side of the housing;

a cartridge which is transported by the carriage and which stores ink;

a nozzle which ejects ink toward the housing, said nozzle being installed on a side of the cartridge facing the housing;

a wiper made of an elastic material for cleaning the nozzle, said wiper being installed in an upper part of the housing;

holding means for holding the wiper by being rotated in a direction of the nozzle when the wiper is bent to one side during cleaning of the nozzle; and operation means for operating the holding means and provided so as to move together with the carriage;

wherein the holding means comprises a rotation rod having a lower part which is axially joined to the housing so as to be rotated by the operation means; and wherein said rotation rod includes a projecting portion provided on one end of the rotation rod and extending toward the housing.

16. The wiping apparatus according to claim 15, wherein the holding means further comprises a restoring spring for restoring the rotation rod to an initial position when an external force applied from the operation means is removed.

17. The wiping apparatus according to claim 15, wherein the operation means comprises an operation rod protruding from the carriage toward the rotation rod.

* * * * *